US009388594B2

(12) United States Patent
Erlich

(10) Patent No.: US 9,388,594 B2
(45) Date of Patent: Jul. 12, 2016

(54) PORTABLE SWIMMING POOL STAIR ASSEMBLY WITH INTEGRAL FILTER AND CIRCULATION SYSTEM

(75) Inventor: Giora J. Erlich, Cedar Grove, NJ (US)

(73) Assignee: GJE Technology LLC, Cedar Grove, NJ (US)

( * ) Notice: Subject to any disclaimer, the term of this patent is extended or adjusted under 35 U.S.C. 154(b) by 603 days.

(21) Appl. No.: 13/524,363

(22) Filed: Jun. 15, 2012

(65) Prior Publication Data

US 2013/0334113 A1 Dec. 19, 2013

(51) Int. Cl.
*E04H 4/14* (2006.01)
*E04H 4/12* (2006.01)

(52) U.S. Cl.
CPC ..... *E04H 4/144* (2013.01); *E04H 4/1209* (2013.01); *E04H 4/1263* (2013.01)

(58) Field of Classification Search
CPC ..... E04H 4/1209; E04H 4/1281
USPC ..... 210/167.1, 167.11, 143, 149
See application file for complete search history.

(56) References Cited

U.S. PATENT DOCUMENTS

| | | | | |
|---|---|---|---|---|
| 2,853,194 | A * | 9/1958 | Webb | 210/409 |
| 3,036,712 | A | 5/1962 | Barbara | |
| 3,090,489 | A | 5/1963 | Smith | |
| 3,139,628 | A | 7/1964 | Richards | |
| 4,193,143 | A | 3/1980 | De Carvalho Vianna | |
| 4,263,139 | A | 4/1981 | Erlich | |
| 4,268,386 | A | 5/1981 | May | |
| 4,342,125 | A | 8/1982 | Hodge | |
| 4,527,297 | A | 7/1985 | Pettit | |
| 4,801,378 | A | 1/1989 | Desjoyaux et al. | |
| 5,239,796 | A | 8/1993 | Maloney | |
| RE35,410 | E * | 12/1996 | Adcock et al. | 4/541.3 |
| 5,715,907 | A | 2/1998 | Andret et al. | |
| 5,849,184 | A | 12/1998 | Veillet | |
| 6,367,584 | B1 | 4/2002 | Edwards | |

(Continued)

FOREIGN PATENT DOCUMENTS

| | | |
|---|---|---|
| FR | 2365014 A1 | 4/1978 |
| FR | 2789599 A1 | 8/2000 |

OTHER PUBLICATIONS

Machine-generated English Translation of FR 2789599, dated Oct. 27, 2014.*

(Continued)

*Primary Examiner* — Fred Prince
(74) *Attorney, Agent, or Firm* — Lerner, David, Littenberg, Krumholz & Mentlik, LLP

(57) ABSTRACT

A swimming pool accessory that is placed into and adjacent a sidewall of the pool includes a staircase assembly constructed from opposing sidewalls that support a plurality of steps that define an interior portion in which a filter assembly is mounted that includes a filter cartridge housing for receiving a removable filter cartridge, a pool skimmer having an inlet that is mounted through one of the opposing sidewalls and an outlet coupled to the filter cartridge housing, and a pump assembly having one end coupled to the filter cartridge housing and a second end forming a water discharge outlet and mounted to the other sidewall. The pump assembly includes a submersible water pump for drawing water through a filter cartridge positioned on the housing and pumping filtered water through the water discharge outlet to create a circulation of water about the interior periphery of the pool.

34 Claims, 9 Drawing Sheets

(56) References Cited

U.S. PATENT DOCUMENTS

| | | | | |
|---|---|---|---|---|
| 6,419,840 | B1 * | 7/2002 | Meincke | 210/767 |
| 6,797,157 | B2 | 9/2004 | Erlich | |
| 6,939,460 | B2 | 9/2005 | Erlich | |
| 7,060,182 | B2 | 6/2006 | Erlich et al. | |
| 2005/0211613 | A1 * | 9/2005 | King | 210/169 |
| 2006/0021922 | A1 * | 2/2006 | Lamberts Van Assche | 210/169 |
| 2010/0288687 | A1 * | 11/2010 | Bassett et al. | 210/232 |

OTHER PUBLICATIONS

International Search Report and Written Opinion for Application No. PCT/US2013/045351 dated Aug. 16, 2013.

* cited by examiner 202
211
205
228
226
218
214
212
206
222
3
208
228
224
206
230
216
204
3
203
214
204
251
210
240
209
232
220
200
204

PORTABLE SWIMMING POOL STAIR ASSEMBLY WITH INTEGRAL FILTER AND CIRCULATION SYSTEM

FIELD OF THE INVENTION

The present invention relates to a submersible pool cleaning apparatus, and more specifically to the installation, operation and maintenance of a filtering device submerged within a swimming pool for separating and isolating undesirable contaminants and debris from the pool environment.

BACKGROUND OF THE INVENTION

Above-ground swimming pools include one or more sidewalls that extend upwardly from the ground to form a circular, oval, rectangular or other well-known or customized shaped pool. The one or more sidewalls are typically fabricated from galvanized steel which is corrugated for additional structural support. The inner and outer surfaces of the sidewall(s) can be coated with a primer and top coat such as a polyester or epoxy paint to help prevent corrosion. A steel frame including a top rail and spaced-apart vertical rails are secured about the external and top surfaces of the sidewall(s) to provide support and integrity of the above-ground pool The frame components can be fabricated from galvanized steel and coated with a polyester coating are also commonly used. A pool liner is installed along the interior surface of the sidewall and bottom surface to isolate and protect the interior wall from the water environment, as well as for aesthetic purposes. The liner is typically fabricated from vinyl, and can have a thickness in the range of 20 to 30 millimeters.

Referring to a representative system of the prior art illustrated in FIG. 1, an external filtering system 104 for filtering water 101 contained by an above-ground swimming pool 100 includes a water skimmer 108, a pump 112, a pressure tank 124 and a filtering device 116 that are installed remotely from the pool 100, usually along the exterior of the sidewall 102. The skimmer 108 is sealingly mounted through a cutout formed through the sidewall 102 and liner 103 of the pool. The skimmer 108 serves as an inlet for receiving water and debris circulating within the pool. Pool water flowing into the skimmer 108 is pumped by the external pump 112 via a first flexible conduit or hose 110 coupled from an outlet of the skimmer 108 to an inlet of the filter device 116. The filter device 116 can be a conventional sand filter, cartridge filter, among other well-known filtering devices. The pool water and debris flow through the filter device 116, where any debris is captured and isolated from the water. The water pump 112 pumps the filtered water 101 through an outlet of the filter device 116 to an inlet of a pressure tank 124 via a second flexible conduit or hose 114. The pressurized filtered water is discharged through a pool discharge port 120 formed in the sidewall 102 of the pool 100 via a third flexible conduit or hose 118 coupled between an outlet of the pressure tank 124 and the pool discharge port 120. The pool discharge port 120 is mounted in a second cutout 122 formed through the sidewall 102 and liner 103 of the pool 100. The water pump 112 receives power from an A/C power source, such as a conventional 120V AC power outlet, and draws large amounts of current in the range of 8-14 amps to operate. The external pump and filter configurations of the prior art are typically able to cycle 15,000 gallons of water in the pool per day. However, the conventional external pumps are designed to deliver power in order to sufficiently pump the water through the set of winding and angled hoses, as opposed to providing energy efficiency.

Although debris is constantly being removed from the pool 100 to provide clear and clean water in the pool for the user's pleasure, remote prior art filtering systems such as the filtering system 104 have numerous disadvantages which can be costly and require a watchful eye to prevent damage to the pool equipment and/or the pool itself. For example, the inherent nature of having to provide at least two cutouts 106, 122 through the sidewall 102 and pool liner 103 to mount the skimmer 106 and the pool discharge port 120 increases the likelihood of water leakage. Although various techniques are used to seal the skimmer and discharge port within their respective cutouts, weathering, water pressure, stresses from pool activity and other factors can cause the seals around the cutouts 106, 122 to deteriorate and leak. If not quickly remedied, water leakage can lead to reduced water levels and undesirable corrosion below and around the cutouts, despite any manufacturer's original protective coatings applied to the sidewall 102 of the pool 100.

Furthermore, the hoses 110, 114, 118 that provide the water flow as between the skimmer 108, the pump 112, the filter device 116 and the discharge port 120 are often connected by angled fittings. As well, the hoses can easily become twisted and kinked during maintenance activities. Additionally, the hoses are often corrugated or have ribs to provide greater flexibility to enable the hoses to bend and curve. The ribs along with the bends in the hose can cause turbulence and frictional losses within the interior of the hose, which reduces the flow rate of the water 101 therethrough. Accordingly, more energy is consumed as the pump must work harder to overcome the lost efficiencies due to the design deficiencies of the prior art external filter systems.

It is often necessary to "winterize" the swimming pool and its equipment in climatic areas where the average ambient temperature drops to levels where water freezes or the use of the pool is temporarily undesirable. The water in the pool is either lowered to a manufacturer's recommended level or completely drained. Additionally, the pool equipment such as the filter system, ladders, floatation devices, and other pool accessories are usually moved to storage areas that offer protection from the winter environment. Accordingly, the home owner must remove and wash the pool equipment/accessories from the pool and then store them away. This biannual ritual is disadvantageously time consuming and can subject such equipment/accessories to damage during disassembly/assembly, as well as during transport from and to the pool.

The prior art includes various examples of pool accessories that have been combined or otherwise consolidated to minimize the number of separate components required to maintain a pool. U.S. Pat. No. 4,801,378 to Desjoyaux et al. discloses a staircase assembly having a submerged front portion with a skimmer, a filter and a recycling outlet. A rear portion includes a pump and electrical apparatus for operation of the filtering system.

U.S. Pat. No. 4,527,297 to Pettit discloses drawing the pool water in and discharging the filtered water below a stair/step assembly positioned along an interior wall of the pool. In U.S. Pat. No. 5,715,907 to Andret et al., a stair assembly having a dual set of ladders is disclosed for use with an above-ground pool. The stair assembly includes a skimmer inlet and a discharge port as part of a ladder positioned within the pool. Long lengths of tubing or piping are routed over the sidewall of the pool to connect the skimmer and discharge port to an external filter/pump system.

The prior art, including the U.S. patents noted above, does not include a submerged water pump for pumping the water through the pool filtering system. Rather, at least the water pump is positioned remotely from the interior portion of the pool, and requires flexible conduits or hoses to be routed through and secured to the filter components of the staircase assembly. Accordingly, these prior art structures are subject to the disadvantages of requiring a high power pump to pump the water through the filtering system, which is inefficient, noisy and expensive to operate. As well, the numerous interconnected components of the external filtering systems can be subject to neglect, abuse and accident during use and storage which can cause poor quality, reliability and maintenance issues and results for the filter system. For example, hoses and separate pump assembly are often connected/disconnected during maintenance, storage and winterizing operations, which can lead to excessive wear-and-tear or permanent damage.

SUMMARY OF THE INVENTION

The above problems are solved and disadvantages avoided by the embodiments of a portable swimming pool staircase assembly with an integral filter and circulation system of the present invention which is described below. In one embodiment, a swimming pool access and filtering apparatus comprises a staircase assembly having opposing vertical sidewalls, a plurality of steps that are positioned between the interior surface of the opposing vertical sidewalls, and each step has a riser extending from its lower surface to an adjacent step. The lower surfaces of the plurality of steps and the interior surfaces of the opposing sidewalls define an interior portion of the staircase assembly.

A filter assembly is mounted within the interior portion of the staircase assembly. The filter assembly comprises a filter cartridge housing for receiving a removable filter cartridge, a pool skimmer having a first end forming a water inlet that is mounted through one of the opposing vertical staircase sidewalls, and a second end coupled to the filter cartridge housing. A pump assembly has a first end coupled to the filter cartridge housing and a second end that forms a water discharge outlet that is mounted to and passes through the opposing vertical sidewall. The pump assembly includes a propeller (or an impeller) attached to a submersible water pump for pumping filtered water through the water discharge outlet.

In one aspect, water and debris in the swimming pool flows into the water inlet and through the filter assembly where the filter cartridge isolates and retains the debris and discharges filtered water. The filtered water is circulated through the water pump assembly by the submersible pump and discharged through the water discharge outlet to recirculate in the swimming pool.

In another aspect, the water discharge outlet includes a diverter valve assembly having an upper outlet and a lower outlet. The diverter valve assembly is configured to selectively discharge filtered water through at least one of the upper and lower outlets.

In one aspect, the filter cartridge housing is mounted vertically within the interior portion of the staircase assembly as shown in FIG. 2. In another aspect, the filter cartridge housing assembly includes a hollow housing, a filter cartridge installed vertically therein, a mesh basket positioned above the filter cartridge and a removable filter cover for enclosing the filter cartridge and mesh basket within the filter cartridge housing. In still another aspect, the pool skimmer is coupled to the filter cartridge housing, both being upstream of the water pump assembly. Alternatively, the filter cartridge housing is mounted horizontally within the interior portion of the staircase assembly as shown in FIG. 7.

In still another aspect, the filter cartridge housing includes a drain for draining the pool water from the filter cartridge housing.

In another aspect, the filter cartridge housing includes a keyed member for interfacing with a corresponding keyed member of the filter cartridge. The filter cartridge housing can include a pump power-cutoff mechanism for deactivating the pump assembly during removal of the filter cartridge.

In one aspect, the plurality of steps includes a top step which is rotatable relative to the opposing sidewalls to permit access to the filter cartridge assembly. In yet another aspect, the plurality of steps includes a top step which is removable from between the opposing sidewalls to permit access to the filter cartridge assembly. In still another aspect, the plurality of steps includes a top step which is removably attached each of the opposing sidewalls by at least one mortise and tenon joint.

In one aspect, the staircase assembly is fabricated from a buoyant material and further comprises at least one ballast weight for maintaining the staircase assembly submerged and positioned on the bottom surface of the swimming pool. In still another aspect, the at least one ballast weight comprises at least one ballast tank mounted to one or both of the staircase sidewalls. The ballast tank is preferably removably mounted on the sidewall and can be filled with a granular material, e.g., sand which is retained by a removable cap so that the tank can be transported (e.g., shipped or carried) empty and subsequently filled on site when the staircase is installed.

In another aspect, the staircase assembly includes at least one handrail fixedly coupled to at least one of the sidewalls. In still another aspect, a bottom portion of each of the opposing sidewalls is releasably secured to a base plate to stabilize the unit and avoid damage to the pool liner. In yet another aspect, the staircase assembly includes a second ladder spaced apart and extending upwardly adjacent to the interior portion to enable access into and out of the pool, e.g., when a deck is not present.

BRIEF DESCRIPTION OF THE DRAWINGS

The invention will be described in further detail below and with reference to the attached drawings in which.

Figure 1:
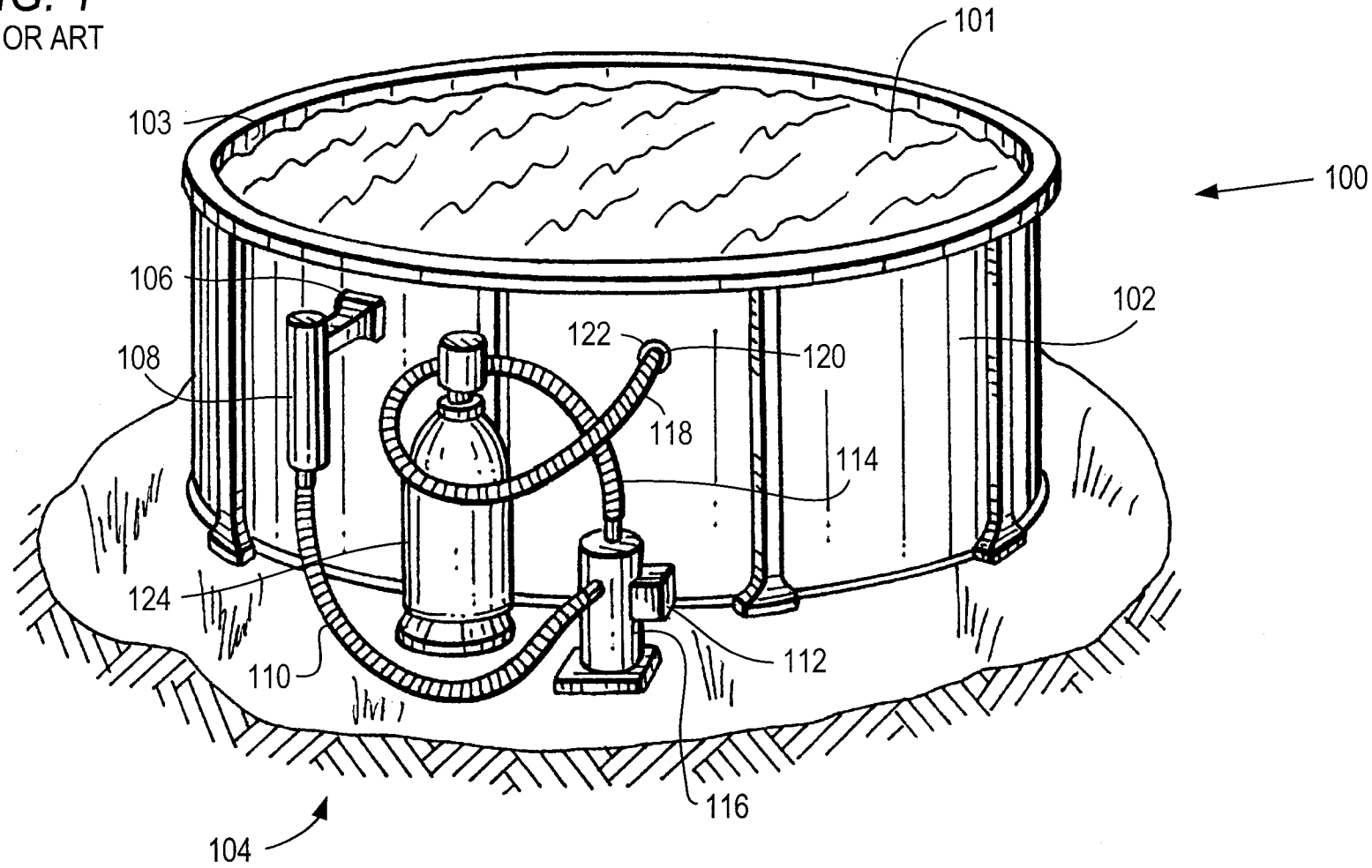
FIG. 1 PRIOR ART
FIG. 1 is a top, side perspective view of a swimming pool and illustrating a prior art external filter assembly for filtering water and debris from the pool.

To facilitate an understanding of the invention, identical reference numerals have been used, when appropriate, to designate the same or similar elements that are common to the figures. Further, unless stated otherwise, the features shown in the figures are not drawn to scale, but are shown for illustrative purposes only.

DESCRIPTION OF THE PREFERRED EMBODIMENTS

For purposes of providing a better understanding the invention, terms connoting direction and positioning of components are defined as follows:

"staircase"—the staircase is composed of a horizontal step and an optional vertical riser.

"stringers"—structural members that support the steps, i.e., the treads and risers.

"tread"—the surface of the step that is contacted by the user's foot. The "width" is measured laterally from one side to the other, and the tread "depth" is the distance between the outer and inner, or edges to the outer surface of the optional vertical "riser" between the steps.

"riser"—a vertical panel extending upward from the top surface or rear edge of a first step (or base plate, if one is used) to an underside or front edge of an adjacent step.

"banister", "railing" or "handrail"—an angled member for handholding while ascending or descending the steps.

"top", "bottom", "upper" and "lower" are adjectives that denote different staircase and/or filter assembly components, as well as define the relative positioning of such components with respect to a vertical axis extending centrally through the staircase and/or filter assembly.

Figure 2:
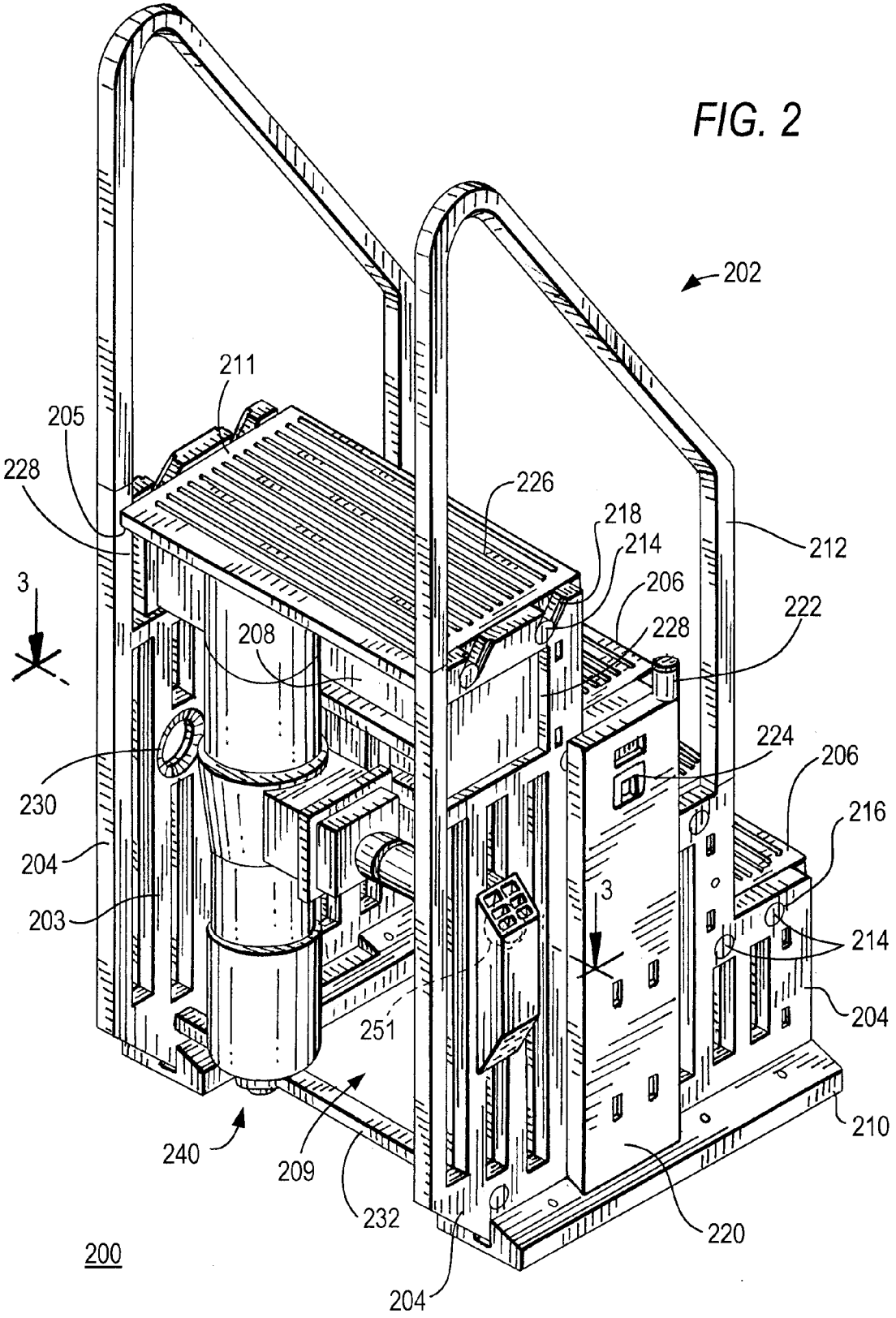
FIG. 2 is a top, left side perspective view of a pool staircase assembly having a submersible filter assembly of the present invention.
Figure 3:
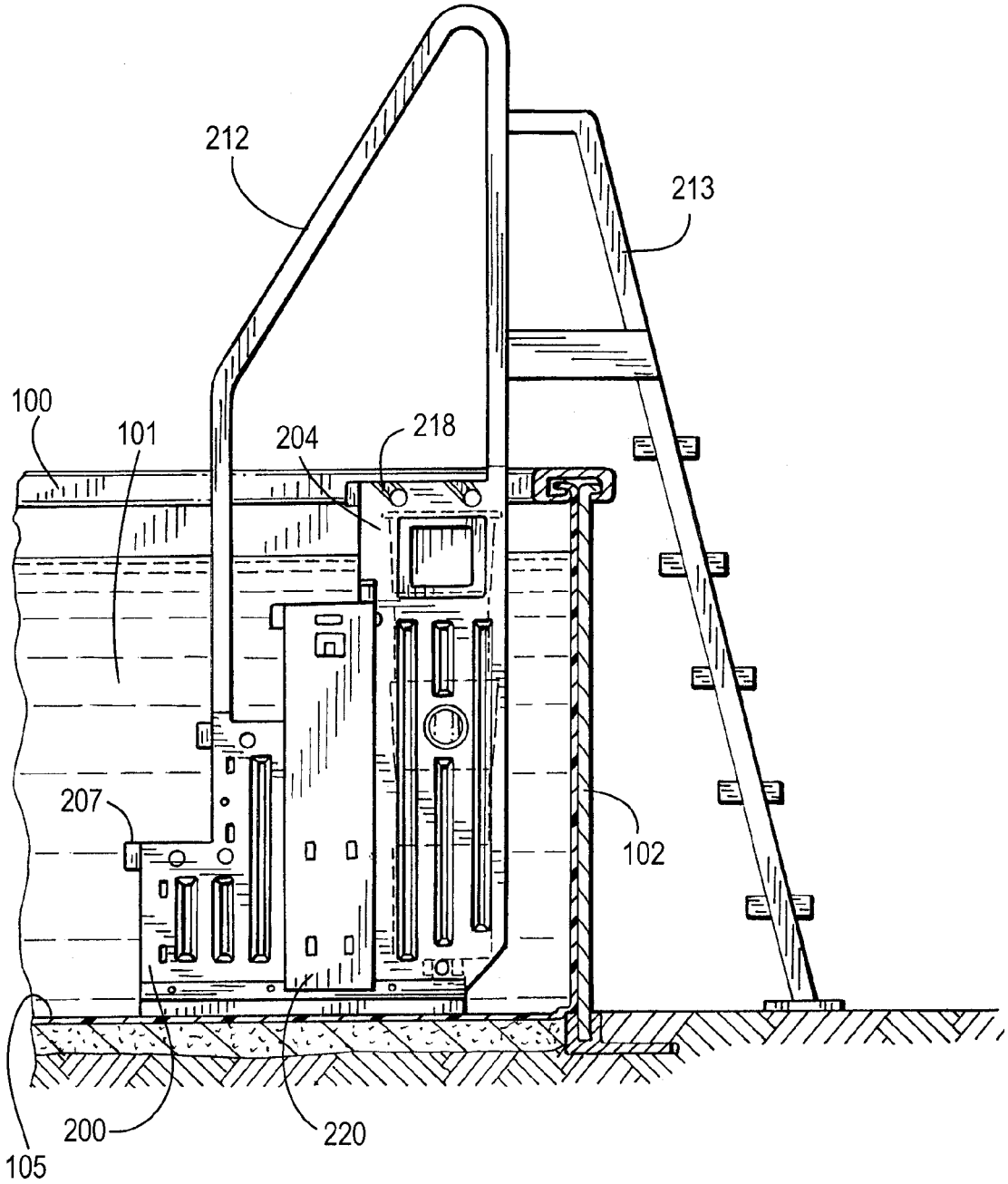
FIG. 3 is an elevated, partial side view of the staircase assembly of FIG. 2 submersed in a swimming pool.

Referring generally to FIGS. 2 and 3, an embodiment of a staircase and filter apparatus 200 of the present invention is illustratively shown. The staircase and filter apparatus 200 includes a staircase assembly 202 and a filter assembly 240. The staircase assembly 202 includes a plurality of steps 206 positioned between a pair of stringers 204 in a conventional inclined arrangement. The plurality of steps 206 includes at least a bottom step and a top step 211. One or more intermediate steps are typically provided between the bottom and top steps as determined by the height of the deck or the sidewall 102 of the pool 100. Each step 206 includes a tread 207 having a width and depth, and an optional riser 208 which extends vertically from the base plate 210 to the underside of the bottom tread, as well as between adjacent treads 207 in a well-known manner.

The parallel stringers 204 are inclined from the bottom step to the top step, and preferably extend downwards from each tread 207 to the base plate or bottom of the pool 100 to form opposing sidewalls of the staircase assembly 202. As illustratively shown in FIG. 2, the stringers 204 are spaced apart the width of the treads 207, although such spacing is not considered as being limiting. For example, the treads 207 can overhang the exterior surfaces of the stringers 204 in a well-known manner. The treads 207 can include a non-slip surface treatment, such as a plurality of grooves 226 formed along the top surface to channel water back into the pool 100. The treads 207 can also include one or more orifices (not shown) formed therethrough to drain surface water back into the pool 100. A person of ordinary skill in the art will appreciate that additional intermediate stringers can be provided between the outer pair of stringers to provide added support to the staircase assembly 202. Alternatively, a single stringer 204 can be provided centrally along the underside of the steps 206. Each stringer 204 can include a base member 210 that extends along the bottom edge of the stringer to provide additional stability along the bottom surface 105 of the pool 100. Additionally, one or more cross-members 232 can be provided laterally between the stringers 204, for example, along the bottom edges of the stringers 204, to provide additional support and stability for the staircase assembly 202. A person of ordinary skill in the art will appreciate that the spacing between the steps and the number of steps is a matter of design choice. As well, the staircase assemblies can be fabricated with a different number of steps and/or stringer inclines to correspond with differing sidewall heights of the pools 100. The stringers, treads, sidewalls and other components can be made from the same or different materials, with or without reinforcement that are preferably resistant to the sun and to chemicals used in the pool, e.g., chlorine-containing disinfectants.

As illustratively shown in FIGS. 1 and 2, the undersides of the plurality of treads 207, the interior surfaces of the stringers 202, and the backsides of the plurality of risers 208 collectively define an underside or interior compartment 209 of the staircase assembly 202. The filter assembly 240 is removably installed within the interior compartment 209 of the stair assembly 202. In this manner, the filter assembly 240 is at least partially covered to thereby protect and hide the filter assembly 240, as described below in further detail with respect to FIGS. 4-8.

Each of the plurality of steps 206 is securely attached to the stringer(s) 204 by at least one fastener. As illustratively shown in FIGS. 1 and 2, the opposing lateral ends of each tread 207 includes a peg 214 which is removably inserted into a corresponding orifice 216 formed in the adjacent stringer 204 to form a mortise and tenon joint. The risers 208 can also be fastened to the pair of stringers by mortise and tenon joints. Alternatively, the risers 208 can be integral with or fastened to the treads 207. A person of ordinary skill in the art will appreciate that other fasteners can be implemented to secure the steps 206 (treads and/or risers) to the adjacent opposing sidewalls 204. For example, L-shaped brackets, bolts, screws and other well-known fasteners can be provided to support and secure the lateral edges of the treads 207 and risers 208 to the stringers 204.

The staircase assembly 202 preferably includes a safety handrail or railing 212 for providing hand support for users ascending up or descending down the steps 206. Referring to FIG. 3, the staircase and filter assembly 200 is positioned inside and proximate the sidewall 102 of the pool 100. The bottom edges of the stringers 204 or its base members 210 are seated on the bottom surface 105 of the pool 100 and the interior compartment 209 which forms the rear portion of the staircase assembly 202 faces the sidewall 102 of the pool.

The height of pool sidewall 102 is a significant determinant in selecting the appropriate staircase assembly 202 to be used, as the number of steps 206 of the staircase assembly can vary based on pool sizes. Further, home owners often install decks around at least a portion of the above-ground pool. As shown in FIG. 3, the four-step staircase assembly 202 illustratively has a top step 211 approximately equal to the height of the pool sidewall 102 or decking (not shown), although such height of the staircase assembly 202 is not considered limiting.

For additional access into and out of the pool 100 where there is no deck access, the staircase assembly 202 can include a secondary staircase or ladder 213 that is coupled to the rear of the staircase assembly 202 such that the pool sidewall 102 is positioned therebetween. The secondary staircase or ladder 213 enables user access into the above-ground pool 100 in the absence of a deck or other platform. The secondary staircase or ladder 213 can be removably coupled to the handrails 213 or to a portion of the stringers 204 that is positioned above the pool sidewall 102. Accordingly, a user can go up the secondary staircase or ladder 213 and step onto or over the top of the pool sidewall 102 to enter the pool by descending down the steps 206 of the staircase assembly 202. The user gets out of the pool 100 by climbing up the staircase assembly 202 and going down the secondary staircase or ladder 213 to the ground outside of the pool 100.

The staircase assembly 202 is preferably fabricated from a lightweight, buoyant or semi-buoyant material, such as polyethylene and/or other plastic materials. Advantageously, a user can easily remove the lightweight/buoyant staircase assembly 200 from the pool 100 for storage during winterization of the pool or other maintenance events. In one embodiment, the stringers 204 and steps 206 are perforated to allow the pool water to enter into the hollow spaces and reduce the buoyancy of the assembly.

Figure 5:
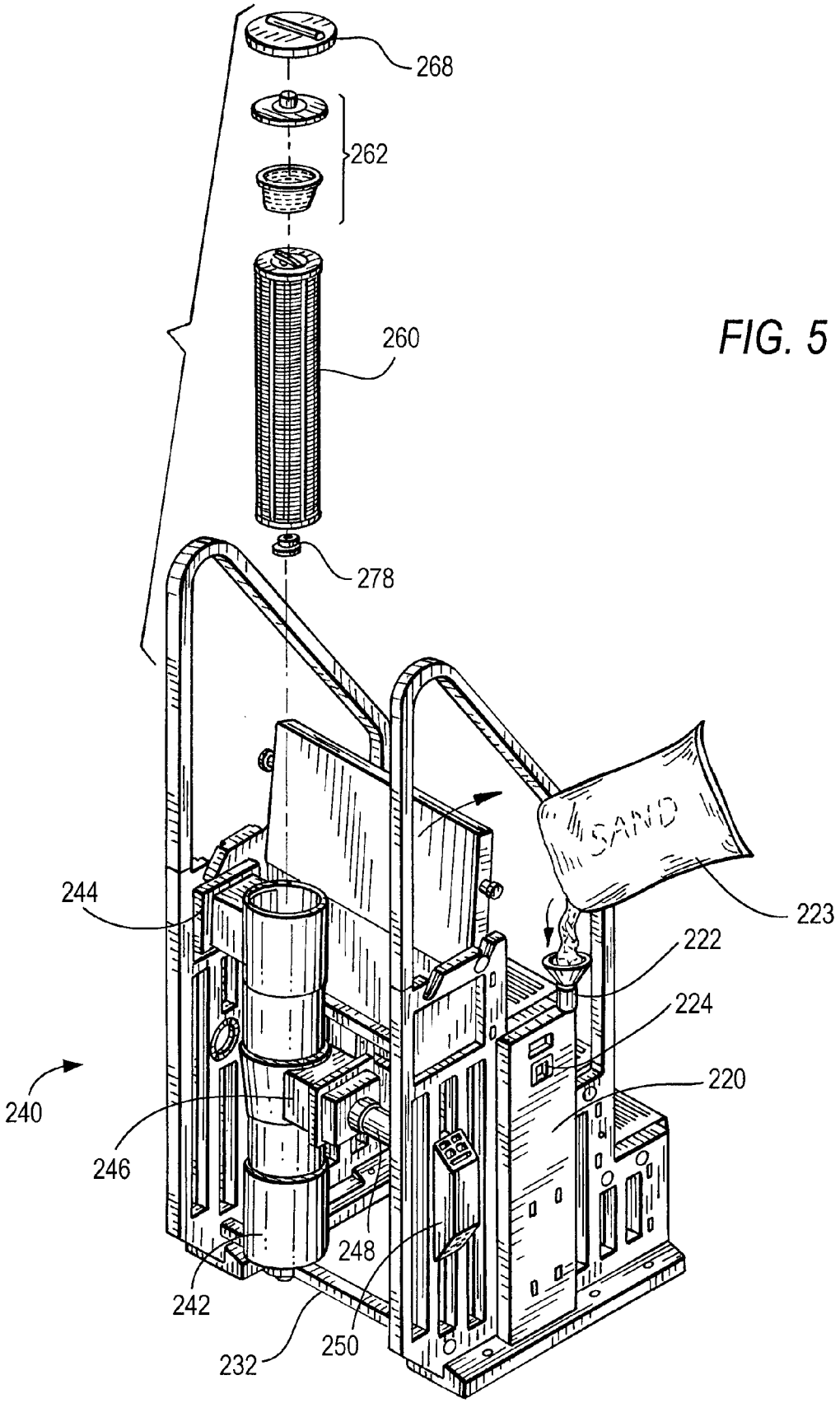
FIG. 5 is top, left side perspective view of the pool staircase assembly of FIG. 2 illustrating an exploded view of the filter assembly.

Referring to FIG. 5, the staircase assembly 202 includes at least one, and preferably a pair of removable ballast tanks 220 that are mounted to the external surface of the stringers 204 via a fastener 224 such as a hook, clasp or other well-known fastener. Preferably, the ballast tanks 220 include a resealable inlet 222 for filling the ballast tanks 220 with a granular material 223, such as sand, gravel and the like. The ballast tanks 220 serve as weights to consistently maintain the staircase and filter assembly 200 in a stable position on the bottom surface of the pool 100. Each ballast tank can illustratively weigh 40-50 pounds (Lbs) or 15-25 kilograms (Kg), although such weights are not considered limiting. When the staircase and filter assembly 200 is being removed from the pool 100, the ballast tanks 220 are unhooked or otherwise detached from the fasteners 224 of the stringers 204 to allow the staircase and filter assembly 200 to easily be lifted out of the pool 100.

Figure 6:
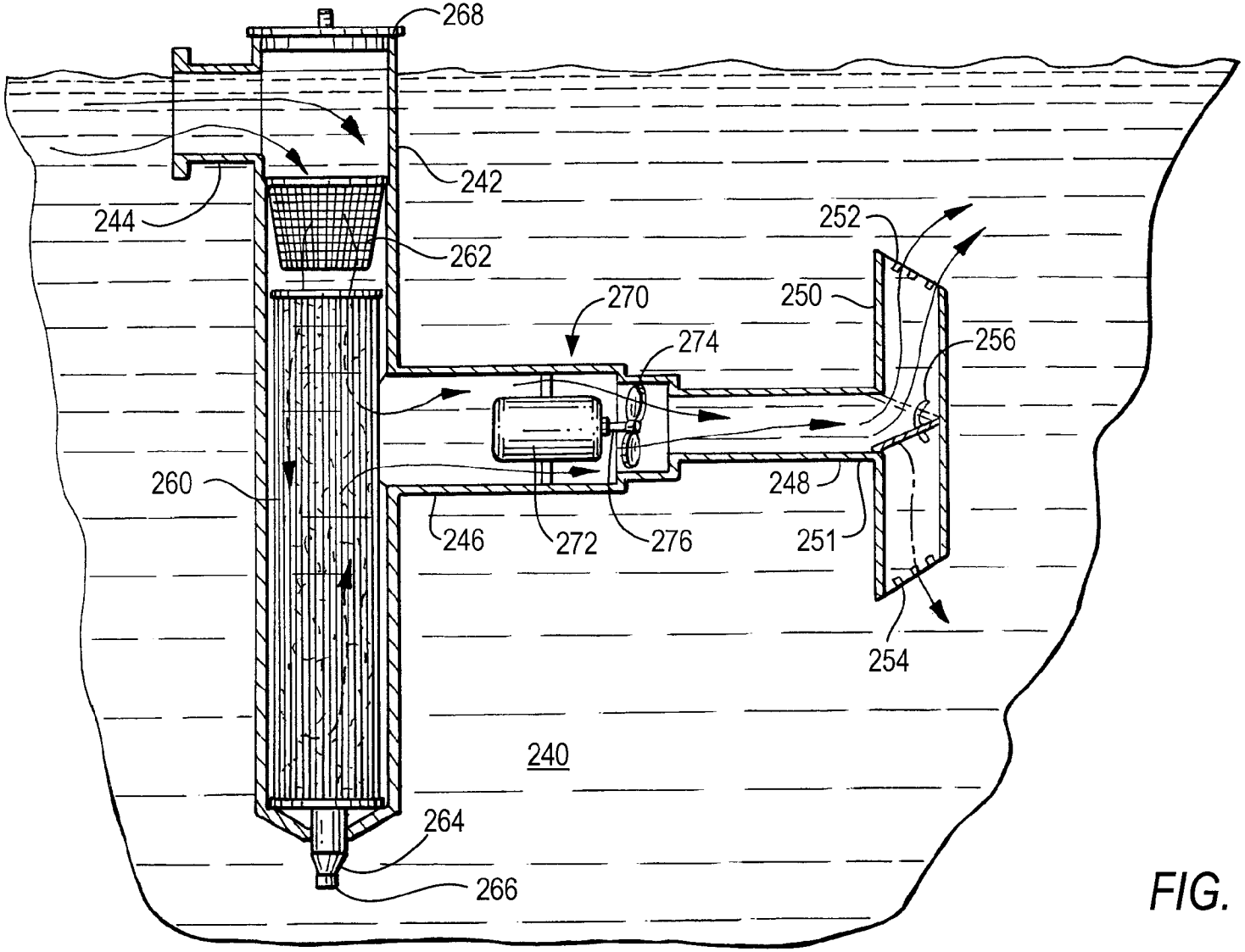
FIG. 6 is a side elevational view of the filter assembly of FIG. 2 and illustrating the flow of pool water therethrough.

Referring now to FIGS. 1 and 6, the filter assembly 240 is positioned within the interior compartment 209 formed between the pair of spaced-apart stringers 204 of the staircase assembly 202. The filter assembly 240 includes a skimmer 244, a filter housing 242 which is configured and dimensioned to receive a filter cartridge 260 and a mesh basket 262, a pump assembly 246, a discharge conduit 248 and an outlet diverter valve assembly 250. In one illustrative embodiment, the filter housing 242 is maintained in a vertical position within the interior compartment 209 by the pool skimmer 244 and the discharge conduit 248. In particular, the skimmer 244 includes a front inlet portion that is secured in an opening 228 formed through one of the stringers 204. The skimmer 244 is positioned such that the inlet is partially submerged, yet breaks the surface of the pool water to collect debris, e.g., leaves, twigs, insects and the like, that is floating on the surface of the pool water. The rear portion of the skimmer 244 is in fluid communication with an upper portion of the filter housing 242 and passes water through the mesh basket 262 which retains any debris collected. A lower portion of the filter housing 242 can be fastened or otherwise secured to the cross-member 232 for additional stability and support.

The pump assembly 246 includes an inlet that is in fluid communication with the filter housing 242 below the pool water line and an outlet that is fluidly attached to a first end of the discharge conduit 248. A second end of the discharge conduit 248 is secured in an opening 230 formed in the other stringer 204 and is in fluid communication with an inlet of the valve assembly 250. The water pump 246 includes an in-line water pump 270 having a waterproof pump housing that contains an electric motor 276 that is coupled to and rotates a propeller (or impeller) 274 via a rotatable shaft 276. The water pump 270 preferably receives its electrical power from a low-voltage power source. In one embodiment, the electric motor 272 of the water pump 270 is electrically coupled to a remote (e.g., pool side) power converter 300 (FIG. 10) or a separate step-down transformer which receives, for example, conventional North American 120V, 60 Hz A/C power as its input, and transforms the input voltage to a 24 volt DC, 0.5 amp output signal, which is provided to the pump motor 272 to serve as its power source. A person of ordinary skill in the art will appreciate that 120V A/C input power can be down-converted to other voltages, for example in the range of 12-50 volts AC or DC, as required, although such voltage range is not considered limiting.

The filter cartridge is preferably cylindrical in shape and includes a pleated, spunbond polyester fabric material, although such fabric material is not limiting. For example, the REEMAY® model filter cartridges 260, fabricated by Fiberweb, PLC, of London, UK, trap dirt and particles as small as two microns, as well as removes algae and bacteria from the pool water. The filter material can include fibers embedded therein to further strengthen the filter material and increase its longevity. Preferably, the filter cartridge includes an inner mesh cartridge and an outer mesh frame fabricated from a flexible thermoplastic material, such as polyethylene and the like to provide structural integrity and to help protect the pleated filter material against damage from contact with large debris (e.g., twigs, leaves, insects, etc.).

The water pump 270 is positioned substantially horizontal within the interior of the pump assembly 246 in a coaxial arrangement such that the water pump 270 and discharge conduit 248 are aligned along a common longitudinal axis to maximize the water pressure while discharging the filtered water in the form of a water jet back into the pool 100. The water pump 270 is positioned downstream from the filter cartridge 260 so that the unfiltered pool water is drawn to the center of the filter cartridge 260 and passes though the pleated filter element, thereby expanding the pleats against the surrounding outer mesh retainer (not shown). The expansion of the pleats advantageously provides an increased surface area for capturing and retaining the undesirable debris and particles within the interior of the filter cartridge 260.

During operation, the water pump 270 is activated and the pool water and any floating debris flows through the skimmer 244 and into the filter housing 260, where the mesh basket 262 initially filters the water by isolating and capturing large pieces of debris. The initially filtered water flows into the interior of the filter cartridge 260, which captures any remaining debris and particles not captured by the mesh basket 262. The initially filtered water flows from the interior of the filter cartridge 260 through the filter cartridge body into the pump assembly 246, where the water pump 270 passes the now-filtered pressurized water through the discharge conduit 248. In one embodiment, the filtered water is discharged through the second end 251 of the discharge conduit 248.

Figure 7:
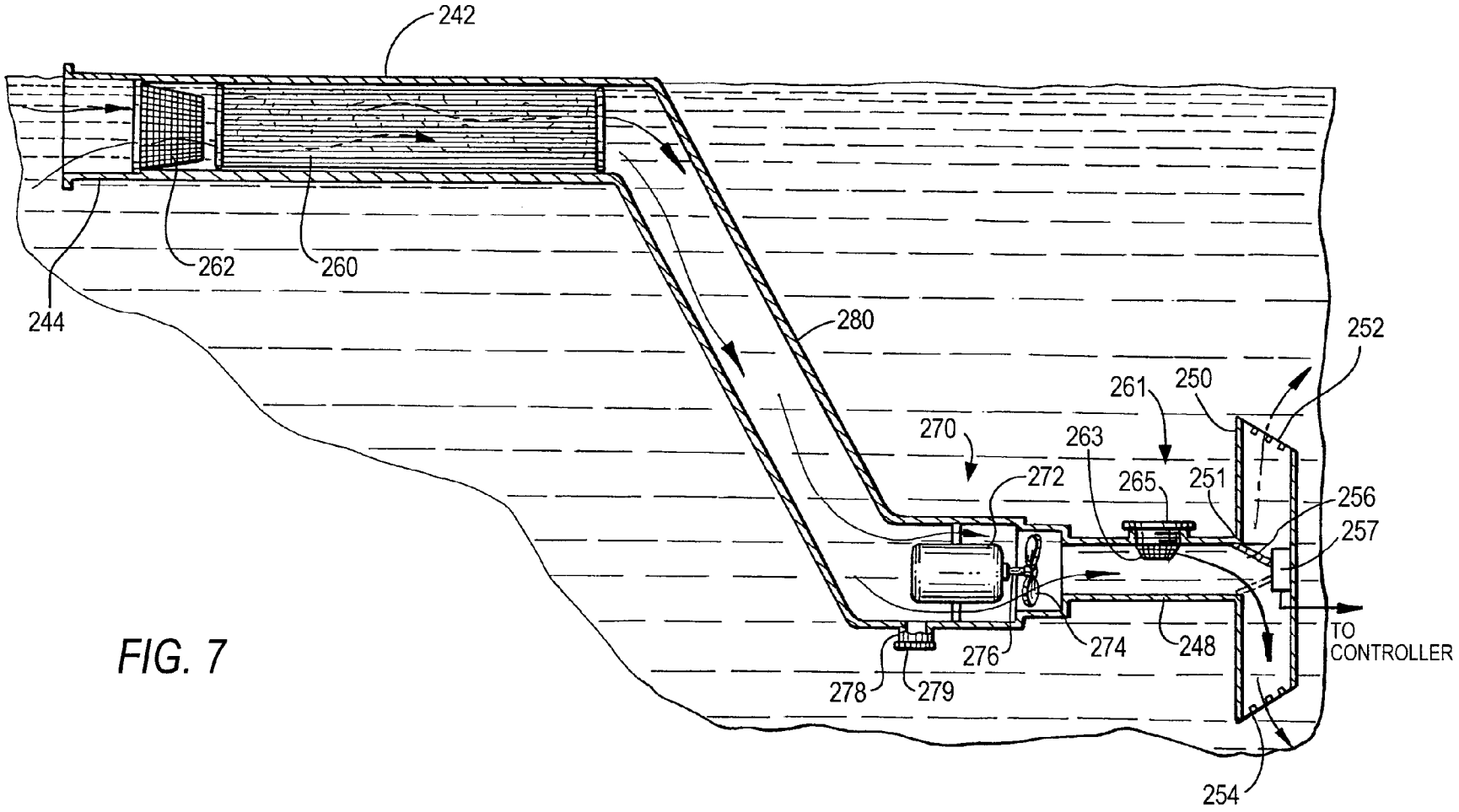
FIG. 7 is a side elevational view of another embodiment of the filter assembly of FIG. 2 and illustrating the flow of pool water therethrough.

Alternatively and as shown in the figures, the water is discharged through the diverter valve assembly 250 having an upper discharge outlet 252, a lower discharge outlet 254 and a valve gate 256. The valve gate 256 can be manually positioned to close off the lower discharge outlet 254 such that the filtered water is recycled back into the pool 100 through the upper discharge outlet 252 as shown in FIG. 6. Alternatively, the valve gate 256 can be manually positioned to close off the upper discharge outlet 252 such that the filtered water is recycled through the lower discharge outlet 252 as shown in FIG. 7. In yet another embodiment, the valve gate 256 can be positioned such that the filtered water flows out of both the lower discharge outlet 254 and the upper discharge outlet 252. A person of ordinary skill in the art will appreciate that the positioning of the gate 256 can be automated and controlled by a servo-motor or solenoid switch 257 as illustratively shown in FIG. 7. A controller 300 such as a timer, light sensor, temperature sensor and the like can send control signals to the switch 257 via an electrical conductor to open and close the upper and lower discharge outlets 252, 254.

During the day, heat radiated by the sun is absorbed by the water in the pool. However, only the top 8-10 inches of water actually receive the benefits of the radiated heat, as the sun is not strong enough to materially increase the temperature of the water below such depths, where the water can be much cooler. Further, during the evenings, the heat absorbed by the water is lost in the absence of the sunlight by convection and evaporation, thereby returning the water to a cooler temperature. Advantageously, the filter assembly 240 can help maintain a more even water temperature throughout the pool, as well as reducing temperature losses due to the "night air" and evaporation. In one embodiment, the controller 300 (e.g., timer or light sensor) can be used to send a control signal to the switch 257 to cause the gate 256 to open and close the upper discharge outlet 252 and the lower discharge outlet 254 at various times of the day in order to direct the warmer water from the top towards the bottom of the pool in an effort to raise and evenly distribute the warmer water throughout the pool. Specifically, the heat that is normally lost during the evening or from evaporation is now mixed with the cooler water at the bottom of the pool, thereby balancing the overall temperature of the water throughout the pool. As the process continues on a daily basis, the temperature of the pool water will generally increase from the previous day, since there will be less evaporation from the surface.

The controller can include a plurality of temperature sensors which are positioned at various depths, such as near the water line and the bottom of the pool 100. The controller 300 monitors the temperature sensors and sends a control signal to the valve gate 250 to either open the lower discharge gate outlet 254 and/or close the upper discharge outlet 252 when a predetermined temperature differential is detected, such as a temperature differential greater than three degrees Fahrenheit, although such temperature differential is not considered limiting.

In yet another embodiment, the controller can be used in conjunction with a chlorine dispenser to dispense chlorine into the pool 100. In one embodiment, chlorine tablets are manually placed in the mesh basket 262, where they are submerged in the water and slowly dissolve in the passing flow through the filter cartridge. While the chlorine tablets are dissolving, the concentrated chlorinated water is drawn through the filter cartridge and expelled through one of the discharge outlets 252, 254 as described above. Chlorine has a specific gravity that is heavier than water and therefore any partially dissolved chlorine tablets will have a tendency to quickly sink. Preferably the valve gate 256 is positioned to close the lower discharge outlet 254 and open the upper discharge outlet 252 while dispensing the chlorine in order to more evenly distribute the dissolving chlorine and prevent high concentrations or "hot spots" of chlorine in areas of the pool 100. Although the chlorine dispenser is described as being the mesh basket 262, a person of ordinary skill in the art will appreciate that the chlorine dispenser can be provided or formed at other locations of the filter assembly 240. For example, the tablets can be placed within the skimmer 244. The chlorine tablets will dissolve as the water is drawn in and through the filter housing 242.

Alternatively and as illustratively shown in FIG. 7, a chlorine dispenser 261 can be formed in the discharge conduit 248. For example, the chlorine dispenser 261 can defined by an opening formed in the sidewall of the discharge conduit 248 in which a mesh screen 263 is positioned horizontally with a removable cover 265 thereover to access and insert the chlorine tablets on the mesh screen 263. The mesh screen 263 can illustratively be concave in shape and the chlorine tablets are retained between the concave mesh screen 263 and the removable cover 265. A person of ordinary skill in the art will appreciate that the shape of the mesh screen and opening in the conduit are not limiting. When the pump 270 is activated, the chlorine tablets are submerged and dissolved by the filtered water from the pump as it passes through the mesh screen 263. The chlorinated water is then discharged into the pool 100 through the discharge outlet 252 and/or 254, as described above.

Figure 4:
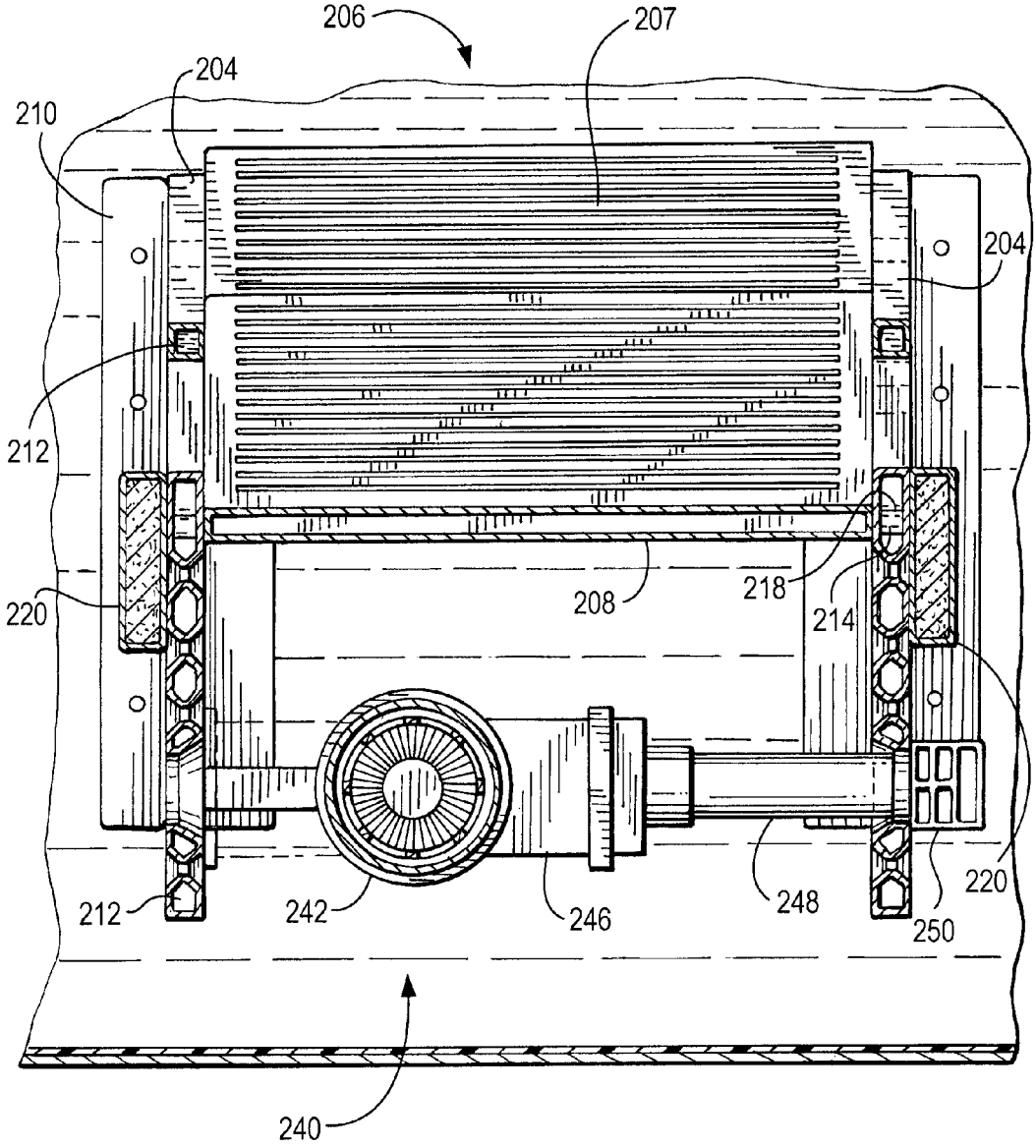
FIG. 4 is a top view the staircase assembly taken along line 3-3 of FIG. 2 and illustrating access to the filter assembly via a rotatable top step.

Referring now to FIGS. 1 and 4, the filter cartridge 260 and mesh basket 262 can be easily and routinely cleaned by slidably opening or removing the top tread 211. The top tread 211 includes a plurality of pegs 214 that are slidably seated in corresponding angled slots 218 formed in the stringers 204. The top tread 211 can be manually rotated ninety degrees (90°) to a vertical position or removed completely from the stringers 204 to provide unimpeded access to the filter housing 242, where the filter housing cover 268 can be lifted off and removed by the user.

The user can then lift the mesh basket 262 and the separate filter cartridge 260 from the filter housing 242 and rinse them off with a hose or faucet to remove dirt and accumulated debris. The cleaned filter cartridge 260 and mesh basket 262 are placed back into the filter housing 242 and the cover 268 is placed thereover for protection, and the top tread 211 is returned to its normal horizontal position within the angled slots 218.

Referring to FIG. 6, a filter housing drain 264 with a removable cap 266 is formed along the bottom of the filter housing 242 to enable the user to completely drain the water from the filter assembly 240. Removal of the pool water from the filter assembly 240 is desirable prior to winterizing and/or storing the staircase and filter assembly 200.

Referring now to FIG. 7, the filter assembly 202 is the same as the embodiment shown in FIG. 6, except that the filter housing 242 is mounted substantially horizontally with respect to the staircase assembly 202. The horizontal arrangement of the filter housing 242 is suitable for wide staircase assemblies or smaller pools having smaller filter cartridge 160. The skimmer 244 is mounted in the opening 228 of the water line of the pool as described above with regard to FIG. 6. A proximate end of the filter housing 242 is removably attached to the back end of the skimmer 244 and the distal end of the filter housing 242 is coupled to the submerged pump assembly 246 via an intermediate conduit 280. The intermediate conduit 280 can be sloped downwards to support the water pump assembly 246 in a submerged position between the filter housing 242 and the discharge conduit 248.

Access to the filter cartridge 260 and mesh basket 262 is accommodated by slidably removing the skimmer 244 from the openings 228 formed in the stringer 204. A user can then slidably remove the basket 262 and filter cartridge 260 from the filter housing 242 for cleaning and replacement, as required. Further, the pump assembly 246 can include a drain 278 and removable cap 279 for draining the filter assembly 240 during winterization and/or storage of the staircase and filter assembly 200.

Figure 8:
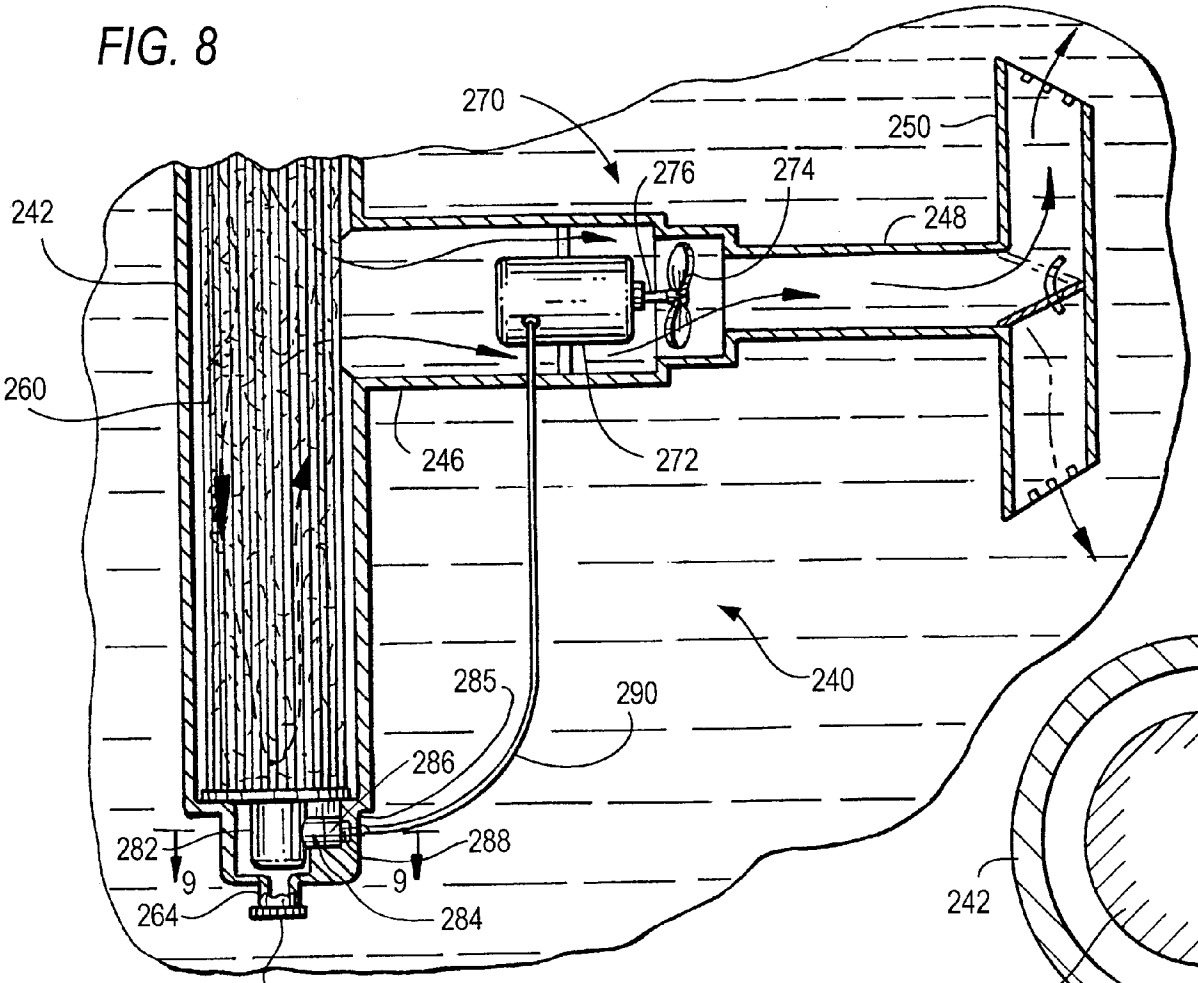
FIG. 8 is a partial exploded view of the filter assembly of FIG. 6 having a keyed filter cartridge with a pump power-cutoff mechanism.
Figure 9:
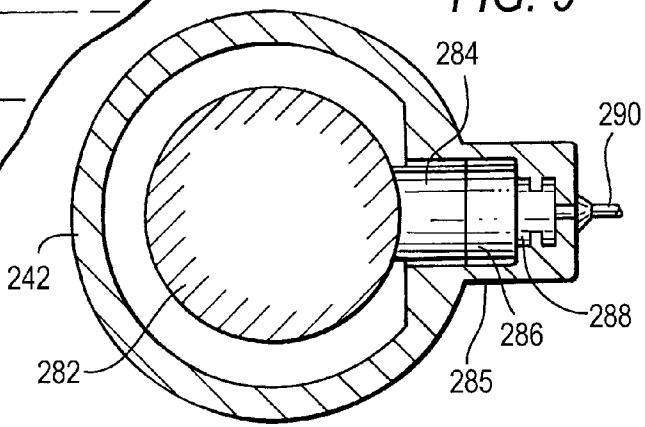
FIG. 9 is a top cross-sectional view taken along lines 9-9 of FIG. 8.

Referring now to FIGS. 8 and 9, the filter assembly 240 can include a keyed filter cartridge 260 having a filter key member 284 which interfaces or mates with a corresponding key member 285 formed in the filter housing 242. As illustratively shown in FIG. 9, the bottom portion or end cap 282 of the filter cartridge 260 includes an outwardly extending male portion 284 which is sized to slidably engage with a corresponding slotted female portion 285 formed along the bottom portion of the filter housing 242. The keying members 284, 285 ensure proper alignment and installation of the filter cartridge 260 in the filter housing 242.

In a further preferred embodiment, the staircase assembly of the invention includes one or more safety shut-off switches or other mechanisms to interrupt electrical power to the pump when one or more events occur that lead to the removal of the mesh after filter basket 262 or the filter cartridge 260. The purpose of turning off the pump is to avoid drawing debris into the system that could damage the filter medium and/or the pump impeller/propeller. In one embodiment, a mercury switch is installed in a recess in the underside of the top step so that when the step is lifted, the electrical circuit to the pump will be opened and the power interrupted; returning the step to the horizontal position will close the circuit and restore power to the pump. Another embodiment comprehends the use of metallic contacts that form part of the power circuit that are fitted in the filter housing and its cover, so that when the cover is turned from its engaged position or removed, the metal contacts are separated and the circuit to the pump is opened and the power interrupted. In a further embodiment of a safety shut-off system, the mesh basket 262 can be provided with a conducting element, e.g., a metal band that extends around its periphery at the top or bottom that contacts a pair of conductors which project into a seat onto which the basket is placed and the peripheral band on the basket completes the circuit. Thus, when the basket is removed for cleaning, the circuit to the pump is opened and the power interrupted. This arrangement assures that sticks or large debris that could damage the filter material will not be drawn into the filter cartridge by the suction of the pump.

It is also important to ensure that large debris does not come into contact with the pump impeller/propeller, which could result in serious damage and expensive repairs, as well as the loss of use of the system. Preferably, the filter assembly 240 further includes a pump power safety shut-off switch 283 that interrupts power to the pump motor 272 when the filter cartridge 260 is removed from or improperly installed in the filter housing 242. In one embodiment, the pump power shut-off switch 283 includes a first electrical contact 286 fastened (e.g., bonded, bolted, and the like) to the end of the male key member 284 and a second electrical contact 288 secured and seated within the filter housing keying member 285. The second electrical contact 288 is electrically connected to the pump motor 272 via a pair of electrical conductors 290. Alternatively, the pump power shut-off switch 283 can include a magnetic switch, such as a well-known "normally open" magnetic switch that turns off when the two magnetic halves of the magnetic switch are separated. In particular, one-half of the magnetic switch can be embedded or mounted to the keyed member 284 of the filter cartridge 260, and the other half of the magnetic switch is embedded or mounted in the corresponding filter housing keying member 285. When the filter cartridge 260 is properly installed in the filter housing 242, the pump power-cutoff switch 283 is in a closed state and electrical power to the pump 270 is provided from the power source (not shown), such as a remote electric power outlet (e.g., GFCI outlet) located near the pool. Conversely, when the filter cartridge 260 is removed from or improperly installed in the filter housing 242, the pump power shut-off switch 283 is in an open state and electrical power to the pump 270 from the power source is interrupted.

Figure 10:
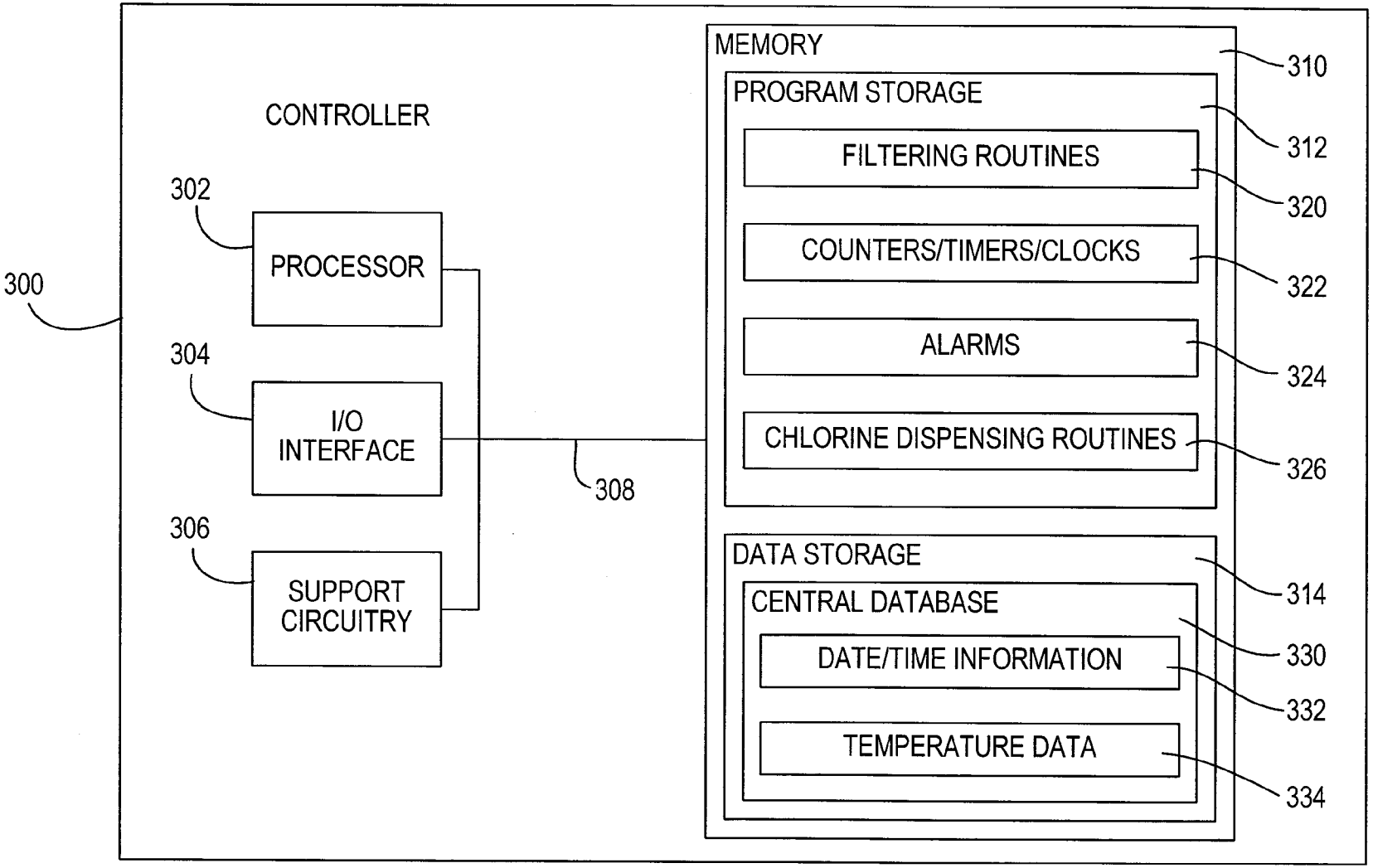
FIG. 10 is a schematic block diagram of a controller suitable for controlling filtering operations in conjunction with the pool staircase and filter assembly of FIG. 2.

Referring now to FIG. 10, a schematic block diagram of a controller 300 suitable for controlling filtering operations of the pool staircase and filter assembly 200 is illustratively shown. The controller 300 includes multi-tasking, real-time software that can concurrently handle hundreds of thousands of queries and updates.

The controller 300 can be any computer device such as a microcontroller. While the controller 300 is shown for illustration purposes as a single computer unit, the system can comprise a group of computing devices which can be scaled depending on the processing load and database size.

Specifically, the controller 300 comprises at least one processor 302, as well as memory 310 for storing various control programs 2112. The processor 302 is preferably a microprocessor or can be any conventional central processing unit (CPU), such as one or more INTEL® processors. The memory 310 can comprise volatile memory (e.g., DRAM), non-volatile memory (e.g., flash memory) and/or a combination thereof. The processor 302 cooperates with support circuitry 306, such as power supplies, clock circuits, cache memory, among other conventional support circuitry, to assist in executing software routines (e.g., methods 320 and 326) stored in the memory 310. The support circuitry 306 can also include a power converter or transformer to reduce power from a conventional 120V a/c socket to a low DC voltage suitable to power the pump motor 272. The one or more processors 302, memory 310 and support circuitry 306 are all commonly connected to each other through one or more bus lines and/or other communication mediums (e.g., cabling) 308.

The controller 300 also comprises input/output (I/O) circuitry 304 that forms an interface between various functional elements communicating with the controller 300. For example, the controller 300 is connected to a communication link through an I/O interface 304, which receives information from one or more sensors, such as a temperature sensor, and sends information (e.g., electrical signals) over a communication link (e.g., an electrical conductor) to the water pump 270 and/or the servomotor 257 of the valve assembly 250. The I/O interface 304 can also include signal communication paths to user interfaces, such as a monitor, keyboard, mouse, among other user interface devices, as well as wireless devices (e.g., Bluetooth and the like).

The memory 310 includes program storage 312 and data storage 314. The program storage 312 stores the filtering routines 320, an operating system (not shown), counters/timers/clocks 322, alarms 324 and other application programs, such as a chlorine dispensing routine 326. In one embodiment, the timers 322 can be used to determine the time of day in order to control the direction (i.e., upward or downward) of the water jet being discharged through the valve assembly 250. The alarm 326 can be used to alert a user of a low pressure condition within the filter assembly 240 which would indicate a blockage condition or a defective water pump 270. The data storage 314 can be an internal or separate storage device, such as one or more flash memory devices, disk drive arrays or other memory devices which can be accessed via the I/O interface 304 to read/write data. The data storage 314 can include a central database 330 which includes date/time data 332, measured pool temperature data 334, as well as other data structures (e.g., tables). The date/time data 332 can include markers identifying predetermined days/times used by the filtering routines 320 for activating the water pump 270 or opening/closing the discharge outlets 252 254 of the valve assembly 250. Similarly, the temperature data 334 can include measured and historical records of the pool temperature at various days/times, as well as predetermined temperature differentials used by the filtering routines 320 for activating the water pump 270 or opening/closing the discharge outlets 252 254 of the valve assembly 250.

The central database 330 is preferably provided internally to the controller 300, although an external database is also comprehended by the present invention. Any of the software program modules in the program storage 312 and data from the data storage 314 are transferred to specific memory locations (e.g., RAM) as needed for execution by the processor 302. As such, it is to be understood that some of the cleaning process steps described as software processes can be implemented within hardware, for example, as circuitry that cooperates with the processor 302 to perform various steps.

It is noted that the operating system (not shown) and optionally various application programs (not shown) are stored in the memory 310 to run specific tasks and enable user interaction, i.e., customize the operational parameters of the filter assembly 240 with respect to the specific pool 100.

For example and as briefly described above, the filtering can be performed randomly or preferably controlled by the programmed filtering routines 320 that operate based on the time of day or the temperature of the water as taken from a number of sensors located at different depths within the pool. The filtering routines 320 can include instructions to send a control signal to the diverter assembly 250 to set the gate 256 in a position to discharge the filtered water in the form of a water jet through the upper discharge outlet 252 to thereby facilitate skimming surface debris at predetermined times of the day. Discharging the filtered water through the upper discharge outlet 252 (hereinafter "skimming function") is advantageous at the beginning of a cleaning cycle where debris may have accumulated during a shutdown period; and then intermittently during the day or towards the end of the filtering cycle. Preferably, the skimming function is set as the default state of operation.

A user can also program the controller so that the filtered water is discharged at predetermined times through the lower discharge outlet 254 to thereby facilitate a "mixing function" for regulating the water temperature throughout the pool. Alternatively, the mixing function can be controlled by setting predetermined temperature differentials in the routine 302 to regulate the water temperature at various depths of the pool 100. For example, a daily filtering cycle can include running the skimming function for a five hour period, powering down for an hour, running the mixing function for five hours, powering down for an hour, running an agitation an thermal cycle (both upper and lower discharge outlets 252 and 254 are open or alternate in an open state for a predetermined time) for five hours, powering down for an hour, running the mixing function for five hours, powering down again for an hour, and repeating the daily cycle the next day. Other daily filtering cycles can be configured by the user based on other factors, such as weather conditions, shading from trees or other obstacles at various times of the day, weekend/weekday usage differences, among other user defined considerations. The user can configure the filtering programs by accessing a graphical user interfaces (GUIs) displayed on a monitor and changing the modes of operation and times of operation with a conventional user interface (keyboard, mouse and the like).

In another example, the user can customize the operation of the filter assembly 240 by interfacing with a keyboard/monitor set predetermined times to dispense chlorine into the pool. The predetermined times can be set so as not to conflict with the skimming and/or mixing function programs described above.

Conventional prior art filter systems typically have a duty cycle of ten hours per day and can pump 15,000 gallons through the system. As well, conventional two-speed pumps typically have a duty cycle of ten hours per day and can pump 8,600 gallons through the system. By comparison, the submerged in-line pump 270 of the present invention is capable of pumping approximately 5000 gallons per hour and has a duty cycle of twenty hours per day. The duty cycle of the in-line pump 70 is double that of the prior art due to the design efficiencies of constantly cooling the submerged pump and eliminating turbulence and frictional power losses associated with the elbows and winding lengths of hoses. Accordingly, approximately 100,000 gallons of water can be filtered per day through the filtering assembly 240 of the present invention. The in-line water pump configuration allows nearly 100% of the pumping capacity to be used moving water, as opposed to wasting energy pressurizing a conventional pressure tank 124. Since the pump 270 is submerged within the pool, the surrounding water keeps the pump cool by quickly dissipating the heat it produces, which can damage the pump motor, and thereby extends the longevity of the water pump 270.

Prior art filter systems generally require the pump to pressurize the external filter tank 116, and then pump the water through corrugated hoses, which greatly reduce the pump's efficiency. The in-line pump design of the present invention avoids the necessity of pressurizing the filter tank, as well as eliminates pressure drops due to the winding/corrugated hoses. Accordingly the pump expends less energy, is cheaper to operate, and is more efficient than the prior art filtering systems.

Advantageously, the staircase and filter assembly 200 eliminates the need to provide cutouts in the sidewall of an above-ground swimming pool to install the filter assembly. Accordingly, installation of the filter assembly is made much easier, since the filter assembly is integral with the staircase assembly, and the combined staircase and filter assembly is simply lifted over the sidewall of the pool and lowered therein such that the top step enables a user to easily climb over the sidewall and into and out of the pool. Moreover, since the cutouts are eliminated, the problems associated with leakages through or around the cutouts are also completely limited. Additionally, the integrity of the pool sidewall is no longer diminished by the cutouts.

With the filter assembly positioned within the pool, corrugated lengths of hoses are also eliminated, which cause pressure losses and are susceptible to twisting and leakage. Further, the in-line design of the pump reduces power consumption and increases energy efficiency by eliminating frictional drag caused by bent and angled hoses and inlets, submerging the pump in the pool water to quickly reduce its temperature during operation, and decreasing the distance the water is pumped through the filtering system. By reducing power consumption of the pump, the operational costs to filter the pool are greatly reduced. For example, an external filter system using a high voltage, twelve-amp external pump in a pool for 10 hours/day can consume 120 kilowatts of power, as compared to the internal filter system with a low voltage, ½ amp in-line pump in the same pool for 20 hours/day can consume as little as 10 kilowatts of power. Over the course of a 120-day season, the cost to operate the external filter system can average $400. By contrast, the cost to operate the internal filter system with the in-line pump configuration over the same 120 day period is only $80, provides a significant savings for the consumer during each season of operation.

Another advantage of the staircase and filter assembly is that the unit is buoyant, lightweight and can be easily lifted out of the pool for storage and/or winterization. Since the filter assembly is integral with the staircase assembly, there are less components to be transported and stored (e.g., no hoses, pressure tanks, external pumps, and the like), thereby reducing storage space requirements and maintenance tasks.

While the foregoing is directed to embodiments of the present invention, other and further embodiments and advantages of the invention can be devised by those of ordinary skill in the art based on this description without departing from the basic scope of the invention, which is determined by the claims that follow.

The invention claimed is:

1. A swimming pool access and filtering apparatus for use in a swimming pool comprising:

a staircase assembly having opposing vertical sidewalls, each sidewall having an interior surface, a plurality of steps positioned between the interior surface of the opposing vertical sidewalls, each step having a lower surface and positioned in a spaced-apart arrangement from an adjacent step, the lower surfaces of the plurality of steps and the interior surfaces of the opposing sidewalls defining an interior portion of the staircase assembly; and a filter assembly mounted within the interior portion of the staircase assembly, the filter assembly comprising a filter cartridge housing for receiving a removable filter cartridge, a pool skimmer having a first end forming a water inlet that is mounted through one of the opposing vertical staircase sidewalls and a second end coupled to the filter cartridge housing, a pump assembly having a first end coupled to the filter cartridge housing and a second end forming a water discharge outlet and mounted to the opposing vertical staircase sidewall, the pump assembly including a submersible water pump for drawing water through the filter cartridge and pumping filtered water through the water discharge outlet, in which a first step of the plurality of steps is at least partially movable to permit access to and removal of the filter cartridge at or via the first step.

2. The apparatus of claim 1, wherein water and debris in the swimming pool flows into the water inlet and through the filter assembly where the filter cartridge isolates and retains the debris to provide filtered water, and the filtered water is pumped through the pump assembly by the submersible pump and discharged through the water discharge outlet to recirculate the filtered water in the swimming pool.

3. The apparatus of claim 1, wherein the water discharge outlet includes a diverter valve assembly having an upper outlet and a lower outlet, the valve assembly being configured to selectively discharge filtered water through at least one of the upper and lower outlets.

4. The apparatus of claim 1, wherein the filter cartridge housing includes a drain for draining the water from the filter cartridge housing.

5. The apparatus of claim 1, wherein the filter cartridge housing is mounted vertically within the interior portion of the staircase assembly.

6. The apparatus of claim 5, wherein the filter cartridge housing includes the filter cartridge installed vertically therein, a mesh basket positioned above the filter cartridge and a removable filter housing cover for enclosing the filter cartridge and mesh basket within the filter cartridge housing.

7. The apparatus of claim 5, wherein the pool skimmer is coupled to the filter cartridge housing above the pump assembly.

8. The apparatus of claim 1, wherein the filter cartridge housing is mounted horizontally within the interior portion of the staircase assembly.

9. The apparatus of claim 1, wherein the filter cartridge housing includes a keyed member and the filter cartridge includes a corresponding keyed member.

10. The apparatus of claim 1, wherein the filter cartridge housing includes a pump power shut-off mechanism that interrupts power to the pump when the filter cartridge is removed.

11. The apparatus of claim 1, wherein the plurality of steps includes a top step which is rotatable relative to the opposing sidewalls to permit access to the filter cartridge housing.

12. The apparatus of claim 1, wherein the plurality of steps includes a top step which is removable from between the opposing sidewalls to permit access to the filter cartridge housing.

13. The apparatus of claim 1, wherein the plurality of steps includes a top step which is removably attached each of the opposing sidewalls by at least one mortise and tenon joint.

14. The apparatus of claim 1, wherein the staircase assembly is fabricated from a buoyant material and further comprises at least one ballast weight for maintaining the staircase assembly submerged and positioned on the bottom surface of the swimming pool.

15. The apparatus of claim 14, wherein the at least one ballast weight comprises at least one hollow ballast tank that is removably mounted to at least one sidewalls of the staircase.

16. The apparatus of claim 15, wherein the at least one ballast tank is filled with a granular material.

17. The apparatus of claim 1, wherein the staircase assembly includes at least one handrail fixedly coupled to at least one opposing sidewall.

18. The apparatus of claim 1 further comprising a base plate mounted to a bottom portion of each opposing sidewall.

19. A filter assembly for use in a swimming pool, the filter assembly comprising:

a filter cartridge housing for receiving a removable filter cartridge;

a pool skimmer having a first end forming a water inlet and a second end coupled to the filter cartridge housing; and a pump assembly having a first end coupled to the filter cartridge housing and a second end forming a water discharge outlet, the pump assembly including a submersible water pump including a propeller for drawing water through the filter cartridge and pumping filtered water through the water discharge outlet, wherein the water pump is in-line of a path along which the water is drawn from the filter cartridge housing to the water discharge outlet, wherein the filter cartridge is substantially cylindrical including pleats, wherein the water drawn through the filter cartridge flows into an interior of the filter cartridge and from the interior of the filter cartridge passes through the filter cartridge, expanding the pleats towards an inside surface of and within the filter cartridge housing, into the pump assembly as filtered pressurized water which the water pump passes through the water discharge outlet.

20. The filter assembly of claim 19, wherein at least one of the skimmer or the second end of the pump assembly is configured for mounting to a staircase assembly.

21. The filter assembly of claim 19, wherein the water pump is operable using about 12-50 volts power.

22. The filter assembly of claim 19, wherein the water pump and the water discharge outlet are aligned along a common axis.

23. The filter assembly of claim 19, where the water discharge outlet includes a diverter valve assembly having an upper outlet and a lower outlet, the valve assembly being configured to selectively discharge the filtered water through at least one of the upper or lower outlets.

24. The filter assembly of claim 23, wherein the diverter valve assembly is operable to selectively discharge the filter water through at least one of the upper or lower outlets in accordance with a control signal.

25. The filter assembly of claim 24, wherein the control signal is determined based on at least one of time, sensed temperature information or information indicating dispensing of chlorine.

26. The filter assembly of claim 24 further comprising:

a chlorine dispenser for dispensing of the chlorine.

27. The filter assembly of claim 19, wherein the filter cartridge housing includes a keyed member and the filter cartridge includes a corresponding keyed member.

28. The filter assembly of claim 19, wherein the filter cartridge housing includes a pump power shut-off mechanism that interrupts power to the pump when the filter cartridge is removed.

29. The filter assembly of claim 19 further comprising:

a conduit extending between the second end of the skimmer and the first end of the pump assembly, the conduit extending transversely from at least one of the second end of the skimmer or the first second end of the pump assembly.

30. The filter assembly of claim 19, wherein the filter assembly is configured to be portable and mountable.

31. The filter assembly of claim 19 further comprising:

a conduit containing the water pump and for passing the filtered water in fluid communication with the water pump to the water discharge outlet.

32. The filter assembly of claim 19, wherein the water discharge outlet includes a valve assembly, in which each positioning state of the valve assembly maintains a continuous flow of the water drawn through the filter cartridge to the water discharge outlet without filtering of the filtered pressurized water in the path at a position which is downstream of the water pump.

33. The filter assembly of claim 19, wherein the skimmer, the filter cartridge housing and the pump assembly are configured such that, in an operating state of the filter assembly in which the filter assembly is installed in a swimming pool with the filter cartridge housing and the pump assembly submerged in the swimming pool, water flowing into the first end of the skimmer is discharged through the water discharge outlet to recirculate in the swimming pool.

34. The filter assembly of claim 19, wherein the first end of the skimmer and the water discharge outlet are aligned along a common axis.

* * * * *